US011827495B2

(12) United States Patent
Li et al.

(10) Patent No.: US 11,827,495 B2
(45) Date of Patent: Nov. 28, 2023

(54) MOUNTING BRACKET FOR GUIDING RAIL OF ELEVATOR AND MOUNTING METHOD THEREOF, LOCATING APPARATUS, BRACKET ADJUSTING APPARATUS AND ELEVATOR SYSTEM

(71) Applicant: Otis Elevator Company, Farmington, CT (US)

(72) Inventors: Bichun Li, Shanghai (CN); Qirui Wang, Shanghai (CN); Gang Huang, Shanghai (CN); Shenhong Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/830,638

(22) Filed: Jun. 2, 2022

(65) Prior Publication Data

US 2023/0133420 A1 May 4, 2023

(30) Foreign Application Priority Data

Nov. 4, 2021 (CN) ..... 202111299672.3

(51) Int. Cl.
*B66B 7/02* (2006.01)
*B66B 19/00* (2006.01)

(52) U.S. Cl.
CPC ..... *B66B 7/023* (2013.01); *B66B 19/002* (2013.01)

(58) Field of Classification Search
CPC ..... B66B 19/002; B66B 19/04; B66B 19/007; B66B 7/023
See application file for complete search history.

(56) References Cited

U.S. PATENT DOCUMENTS 7,654,006 B1 * 2/2010 Mooney ..... B66B 7/1246 33/286
9,957,136 B2 * 5/2018 Hawkins ..... B66B 19/002

FOREIGN PATENT DOCUMENTS

| | | | |
|---|---|---|---|
| CN | 106946117 B | | 10/2018 |
| CN | 115092795 A | * | 9/2022 |
| EP | 3085658 A1 | | 10/2016 |
| EP | 3090976 A1 | | 11/2016 |
| KR | 101451017 B1 | * | 10/2014 |

OTHER PUBLICATIONS

European Search Report for Application No. 22205662.4; dated Mar. 9, 2023; 7 Pages.

* cited by examiner

*Primary Examiner* — Diem M Tran
(74) *Attorney, Agent, or Firm* — CANTOR COLBURN LLP

(57) ABSTRACT

An elevator guide rail installation bracket and installation method thereof, a positioning tooling, a bracket adjustment tooling, and an elevator system. The elevator guide rail installation bracket includes a guide rail bracket having a guide rail installation surface and a first adjustment surface that form a bend, a fixed guide rail installation position is provided on the guide rail installation surface; and a hoistway bracket having a hoistway installation surface and a second adjustment surface that form a bend; the first adjustment surface is adjustably connected to the second adjustment surface to adjust the relative position between the guide rail installation surface and the hoistway installation surface.

3 Claims, 6 Drawing Sheets

MOUNTING BRACKET FOR GUIDING RAIL OF ELEVATOR AND MOUNTING METHOD THEREOF, LOCATING APPARATUS, BRACKET ADJUSTING APPARATUS AND ELEVATOR SYSTEM

FOREIGN PRIORITY

This application claims priority to Chinese Patent Application No. 202111299672.3, filed Nov. 4, 2021, and all the benefits accruing therefrom under 35 U.S.C. § 119, the contents of which in its entirety are herein incorporated by reference.

FIELD OF THE INVENTION

The present application relates to the field of elevator installation, and in particular to the installation method and related tooling for a guide rail installation bracket of an elevator system.

BACKGROUND OF THE INVENTION

As a tool to facilitate passengers' walking between floors or shorten passengers' walking distance, passenger transport devices are very common in daily life. As an example, the most common ones are escalators and elevators generally used between the floors of commercial buildings, and moving walkways generally used in large airports.

For an elevator system, it has an elevator car that usually runs in a dedicated hoistway. Usually, a set of guide rails are arranged oppositely on the inner wall of the hoistway, and guide shoes or guide wheels are arranged on the elevator car accordingly to guide the car to move in the hoistway. A guide rail in practical application is usually formed by connecting multiple guide rail segments end to end, and an elevator guide rail installation bracket is arranged at the connection point of adjacent guide rail segments to realize the positioning and fastening of the two.

For the guide rail installation process, it is required that the adjacent guide rail segments can be accurately aligned, so as to avoid interference or unnecessary vibration when the car passes through the joints. In order to meet this requirement, usually, after the installation bracket is arranged roughly at the installation point, its precise positioning is achieved by adjusting the guide rail, thereby achieving precise alignment of the two at the joints. However, during the adjustment process, the larger length, size and weight of the guide rail will impose higher operating requirements and load-bearing capacity on the operator.

SUMMARY OF THE INVENTION

The present application aims to provide an elevator guide rail installation bracket and installation method thereof, positioning tooling, bracket adjustment tooling, and an elevator system, so as to solve or at least alleviate some of the aforementioned technical problems.

In order to achieve at least one objective of the present application, according to one aspect of the present application, an elevator guide rail installation bracket is provided, comprising: a guide rail bracket having a guide rail installation surface and a first adjustment surface that form a bend, wherein a fixed guide rail installation position is provided on the guide rail installation surface; and a hoistway bracket having a hoistway installation surface and a second adjustment surface that form a bend; wherein the first adjustment surface is adjustably connected to the second adjustment surface to adjust the relative position between the guide rail installation surface and the hoistway installation surface.

In addition to one or more of the above features, or as an alternative, in another embodiment, the first adjustment surface is provided with first adjustment slot holes, and the second adjustment surface is provided with second adjustment slot holes alternately arranged with the first adjustment slot holes, wherein the first adjustment surface is adjustably connected to the second adjustment surface by screwing the first adjustment slot holes and the second adjustment slot holes at different positions.

In addition to one or more of the above features, or as an alternative, in another embodiment, a plurality of guide rail fixing circular holes are provided on the guide rail installation surface to define the fixed guide rail installation position.

In addition to one or more of the above features, or as an alternative, in another embodiment, third adjustment slot holes are provided on the hoistway installation surface; wherein the hoistway installation surface and the second adjusting surfaces are replaceable with each other, and the third adjustment slot holes and the first adjustment slot holes are alternately arranged.

In order to achieve at least one objective of the present application, according to another aspect of the present application, an elevator system is provided, comprising the elevator guide rail installation bracket as described above.

In order to achieve at least one objective of the present application, according to still another aspect of the present application, a positioning tooling for an elevator car is provided, comprising: a fixing mechanism detachably fixed to an elevator car in a construction hoistway; a telescopic mechanism connected to the fixing mechanism, and configured to extend to or retract from the wall surface of the construction hoistway; and a positioning mechanism provided at the end of the telescopic mechanism, and configured to abut against the wall surface of the construction hoistway along with the extending motion of the telescopic mechanism.

In addition to one or more of the above features, or as an alternative, in another embodiment, the telescopic mechanism is pivotally connected to the fixing mechanism, and is configured to rotate between the position facing the wall surface of the construction hoistway and the position deviating from the wall surface of the construction hoistway.

In addition to one or more of the above features, or as an alternative, in another embodiment, the fixing mechanism comprises a clamping bracket for clamping and being detachably fixed to a top guardrail of the elevator car in the construction hoistway.

In addition to one or more of the above features, or as an alternative, in another embodiment, the telescopic mechanism comprises: a base connected to the fixing mechanism, with a threaded through hole provided thereon; and a telescopic screw screwed to the threaded through hole of the base, with its end provided with the positioning mechanism; wherein the rotating motion of the telescopic screw relative to the base is converted into the extending motion or retracting extending motion of the telescopic screw to or from the wall surface of the construction hoistway.

In addition to one or more of the above features, or as an alternative, in another embodiment, the positioning mechanism comprises a wall surface support seat, wherein a first side of the wall surface support seat is provided with a gasket, a second side of the wall surface support seat is arranged at the end of the telescopic mechanism, and the gasket abuts against the wall surface of the construction hoistway along with the extending motion of the telescopic mechanism.

In order to achieve at least one objective of the present application, according to another aspect of the present application, a bracket adjustment tooling for elevator guide rail installation is provided, comprising: a working platform detachably fixed to an elevator car in a construction hoistway, with a linear motion mechanism and a swing mechanism provided thereon; and a first calibration arm and a second calibration arm respectively provided on the working platform that, driven by the linear motion mechanism and/or the swing mechanism, moves linearly and/or swings along with the working platform; wherein, the first calibration arm and the second calibration arm are configured to jointly hold the elevator guide rail installation bracket.

In addition to one or more of the above features, or as an alternative, in another embodiment, end limiting walls and side limiting walls are provided at the ends of the first calibration arm and the second calibration arm facing the wall surface of the construction hoistway, and the end limiting walls and the side limiting walls jointly define the relative position between the elevator guide rail installation bracket, and the first and second calibration arms.

In addition to one or more of the above features, or as an alternative, in another embodiment, magnetic attraction elements are provided at the ends of the first calibration arm and the second calibration arm facing the wall surface of the construction hoistway, wherein the magnetic attraction elements is controlled to generate magnetic force to attract the elevator guide rail installation bracket made of metal.

In addition to one or more of the above features, or as an alternative, in another embodiment, the linear motion mechanism comprises: a first power source, and a first platform driven to drive the first calibration arm and the second calibration arm to move in a first direction; a second power source, and a second platform driven to drive the first calibration arm and the second calibration arm to move in a second direction; wherein, the first direction is perpendicular to the second direction; and/or the swing mechanism comprises: a third power source, and a third platform driven to swing the first calibration arm and the second calibration arm in a plane formed by the first direction and the second direction.

In addition to one or more of the above features, or as an alternative, in another embodiment, the bracket adjustment tooling further comprises: a telescopic leveling mechanism, with its first end connected to the working platform, and its second end detachably fixed to an elevator car in a construction hoistway used as a leveling reference point, configured to extend or retract to level the working platform.

In order to achieve at least one objective of the present application, according to another aspect of the present application, a method for installing an elevator guide rail installation bracket is provided, comprising: a positioning step to fix the relative position between an elevator car and a construction hoistway at a set construction height in the construction hoistway, and to fix the relative position between a bracket adjustment tooling and the elevator car; a calibration step to perform a longitudinal adjustment, lateral adjustment and swing adjustment on the elevator guide rail installation bracket relative to the wall surface of the construction hoistway using the bracket adjustment tooling, so as to realize the positioning of the elevator guide rail installation bracket relative to the wall surface of the construction hoistway; and an installation step to fasten the elevator guide rail installation bracket and the wall surface of the construction hoistway.

In order to achieve at least one objective of the present application, according to another aspect of the present application, a method for installing the elevator guide rail installation bracket as described above is provided, comprising: a positioning step to fix the elevator car that moves at a set construction height in the construction hoistway to the wall surface of the construction hoistway, and to fix the bracket adjustment tooling as described above to the top of the elevator car; a calibration step to hold the guide rail bracket of the elevator guide rail installation bracket using the first calibration arm and the second calibration arm of the bracket adjustment tooling, and to perform a longitudinal adjustment, lateral adjustment and swing adjustment on the guide rail bracket relative to the wall surface of the construction hoistway through the working platform of the bracket adjustment tooling, and adjust the relative position between the guide rail installation surface of the guide rail bracket and the hoistway installation surface of the hoistway bracket to realize the positioning of the hoistway installation surface relative to the wall surface of the construction hoistway; and an installation step to fasten the hoistway bracket and the guide rail bracket, and fasten the hoistway bracket and the wall surface of the construction hoistway.

According to the elevator guide rail installation bracket and the method of installing the elevator guide rail installation bracket of the present application, a guide rail bracket and a hoistway bracket capable of adjusting the relative position are provided, so that the installation bracket itself has a certain adjustment ability, which can first adjust itself and then install the guide rails with precise positioning, so that the adjustment process of the guide rail installation process changes from the adjustment to an excessively heavy and long guide rail itself to the adjustment to a lighter and more compact elevator guide rail installation bracket, thereby optimizing the process operation accordingly. The positioning tooling and the bracket adjustment tooling according to the present application can be used in conjunction with the method of installing the elevator guide rail installation bracket to optimize the positioning and adjustment process. The elevator system according to the present application, however, applies the corresponding elevator guide rail installation bracket and the installation method thereof, thereby having efficiently and accurately aligned guide rails, optimizing its operating experience and improving its construction process.

DETAILED DESCRIPTION OF THE EMBODIMENT(S) OF THE INVENTION

The present application will be described in detail hereinafter with reference to the exemplary embodiments shown in the accompanying drawings. However, it should be understood that the present application can be implemented in many different forms, and should not be construed as being limited to the embodiments set forth herein. These embodiments are provided here for the purpose of making the disclosure of the present application more complete and comprehensive, and fully conveying the concept of the present application to those skilled in the art.

In addition, for any single technical feature described or implied in the embodiments mentioned herein, or any single technical feature displayed or implied in each drawing, the present application still allows any continued arbitrary combination or deletion of these technical features (or the equivalents thereof) without any technical obstacles, thereby obtaining more other embodiments of the present application that may not be directly mentioned herein.

Figure 1:
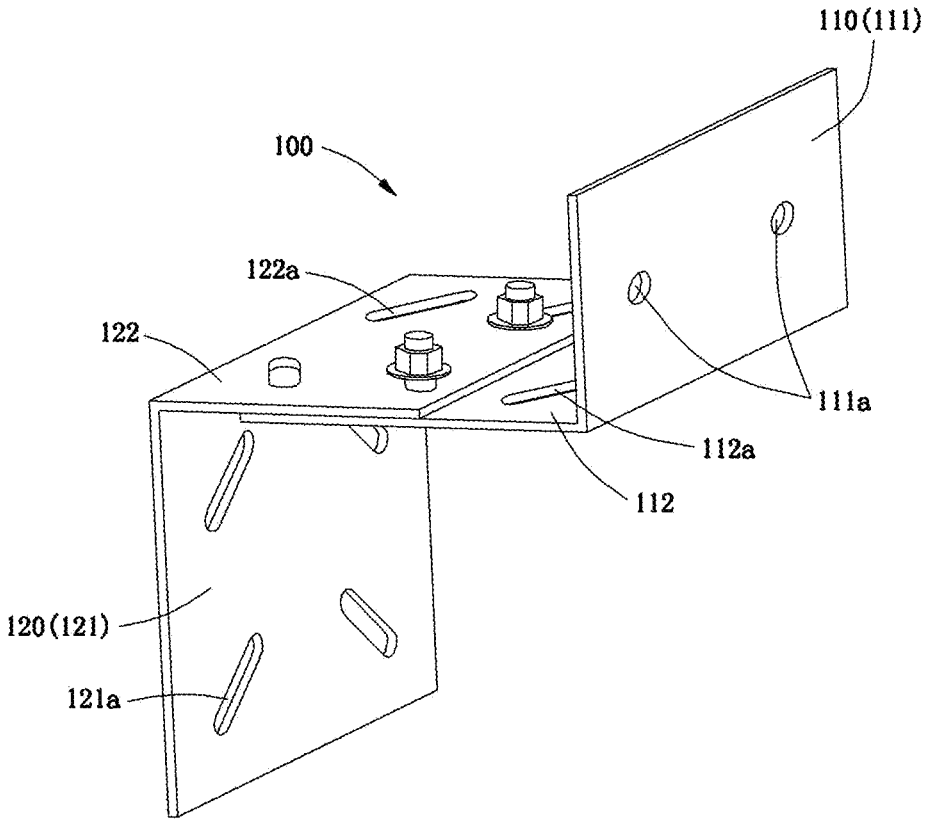
FIG. 1 is a schematic diagram of an embodiment of an elevator guide rail installation bracket.
Figure 2:
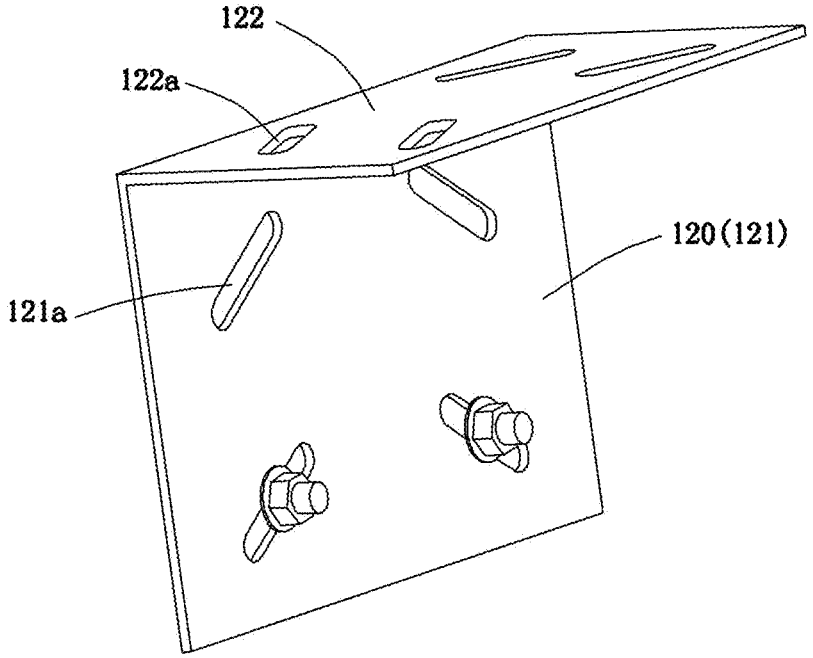
FIG. 2 is a schematic diagram of a hoistway bracket of the elevator guide rail installation bracket in FIG. 1.
Figure 3:
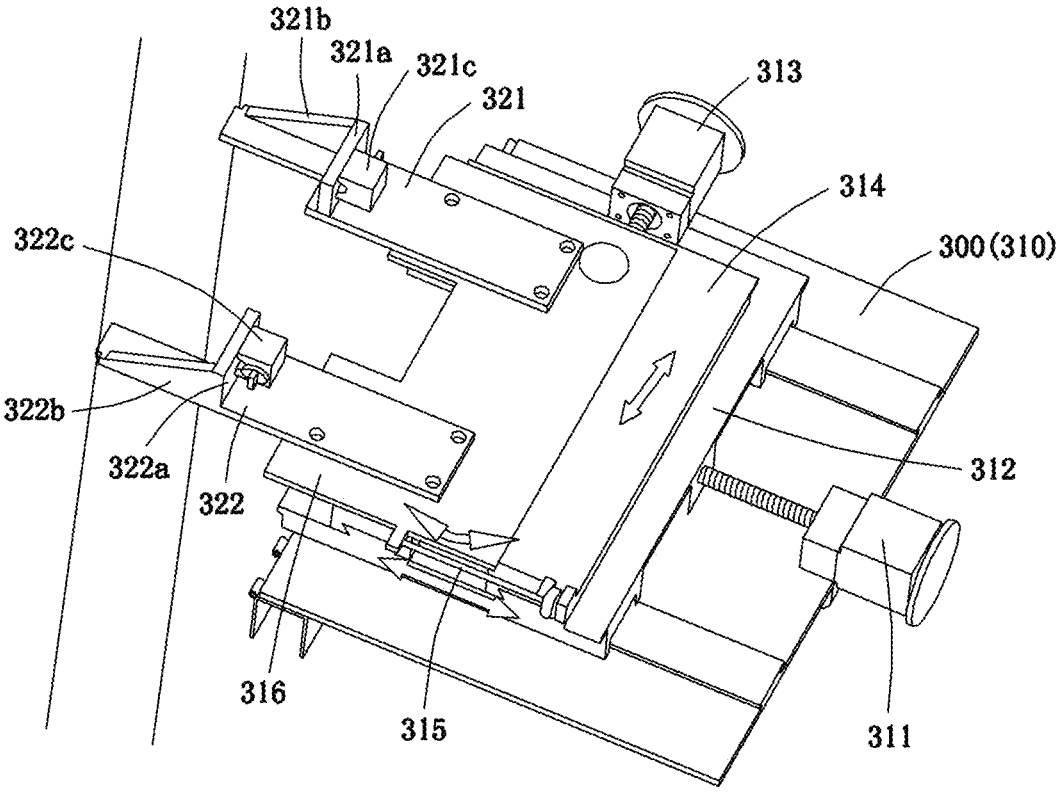
FIG. 3 is a schematic diagram of an embodiment of a bracket adjustment tooling.
Figure 4:
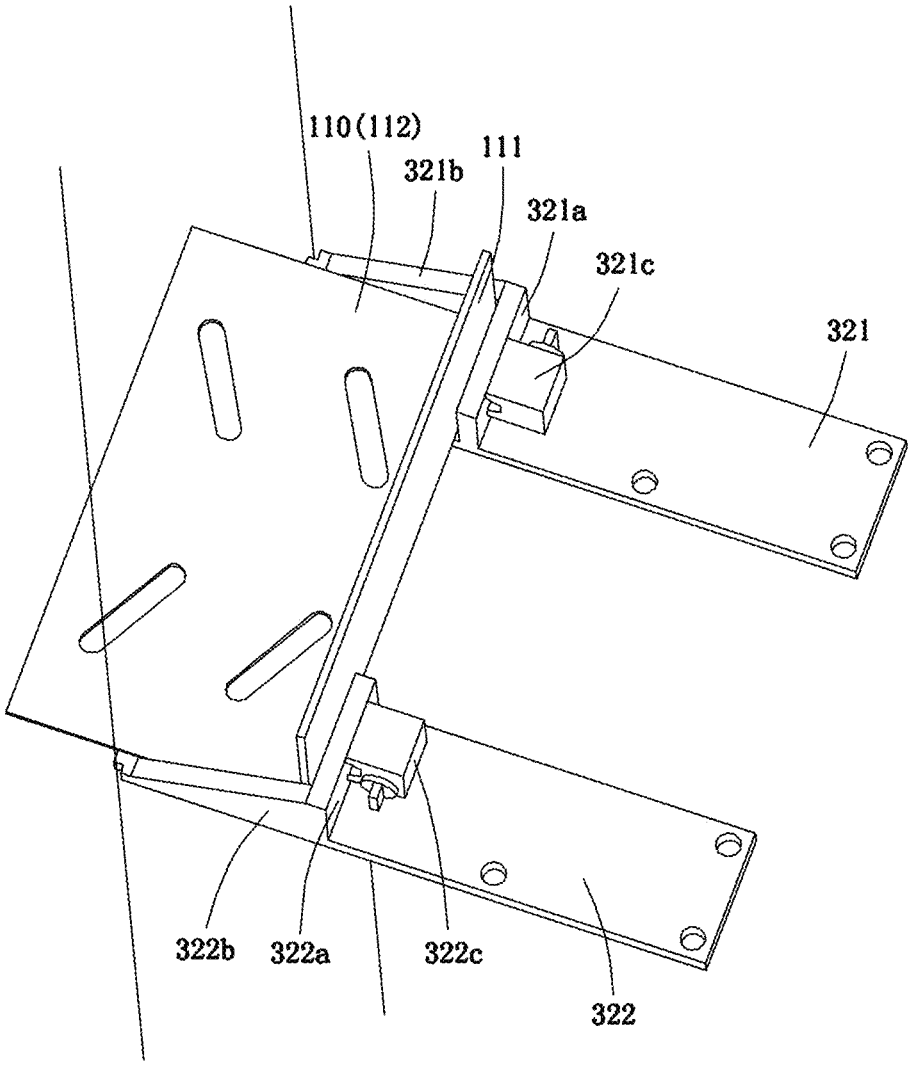
FIG. 4 is a schematic diagram of a first view of the bracket adjustment tooling in FIG. 3 in cooperation with the elevator guide rail installation bracket.
Figure 5:
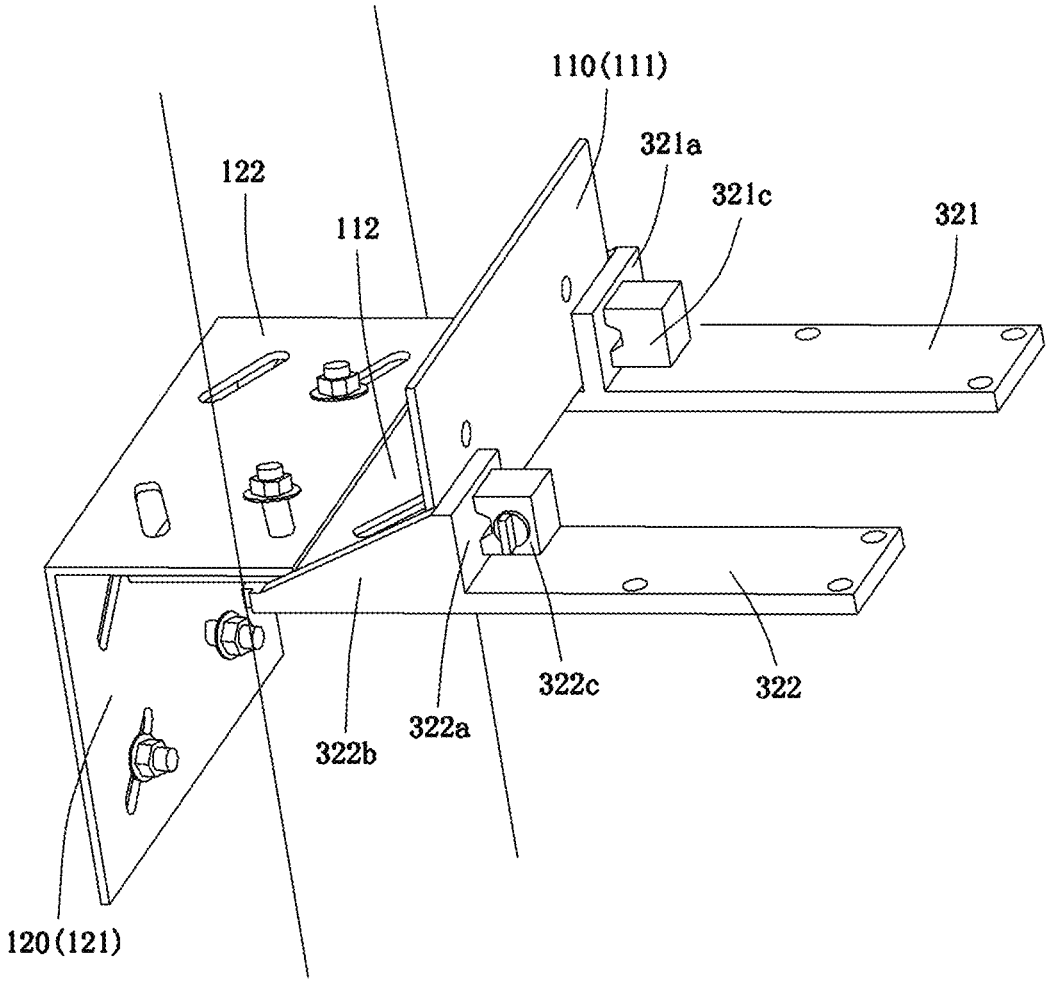
FIG. 5 is a schematic diagram of a second view of the bracket adjustment tooling in FIG. 3 in cooperation with and the elevator guide rail installation bracket.
Figure 6:
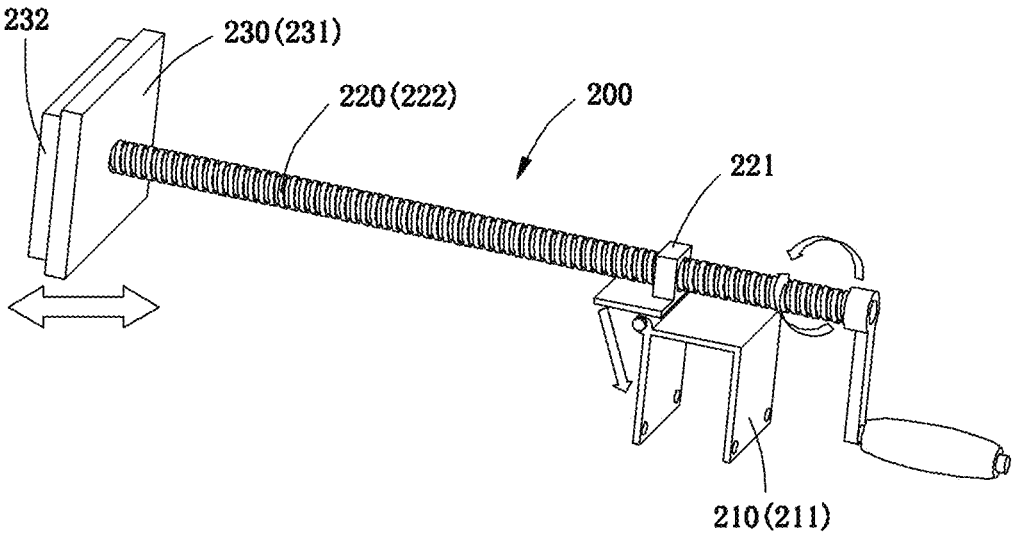
FIG. 6 is a first-view schematic diagram of an embodiment of a positioning tooling.
Figure 7:
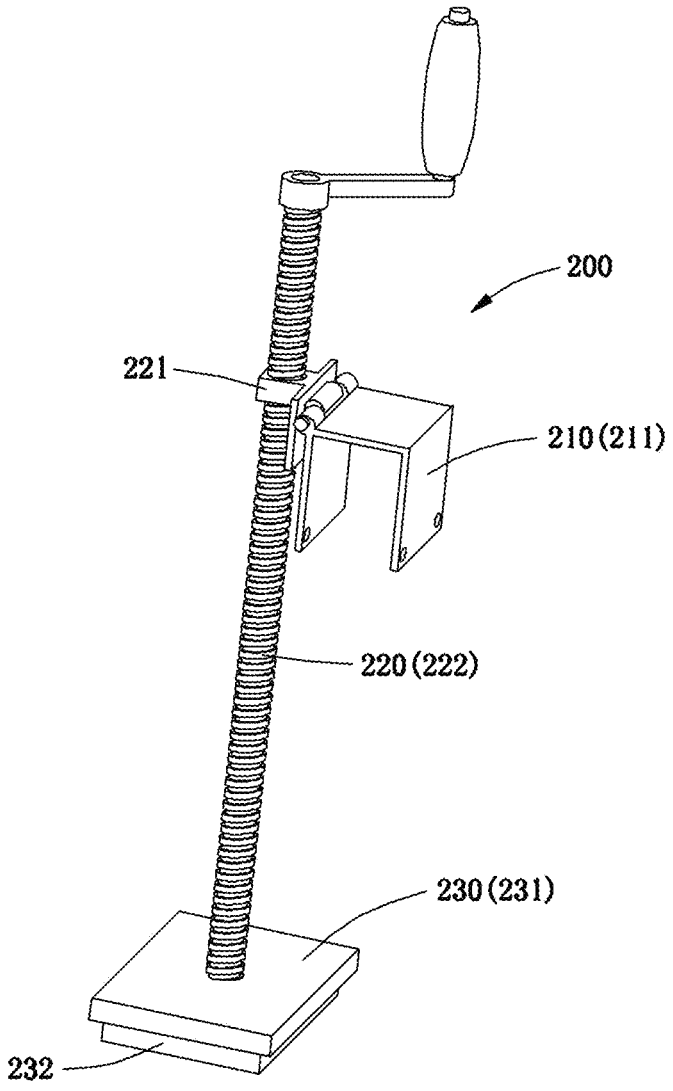
FIG. 7 is a second-view schematic diagram of an embodiment of a positioning tooling.
Figure 8:
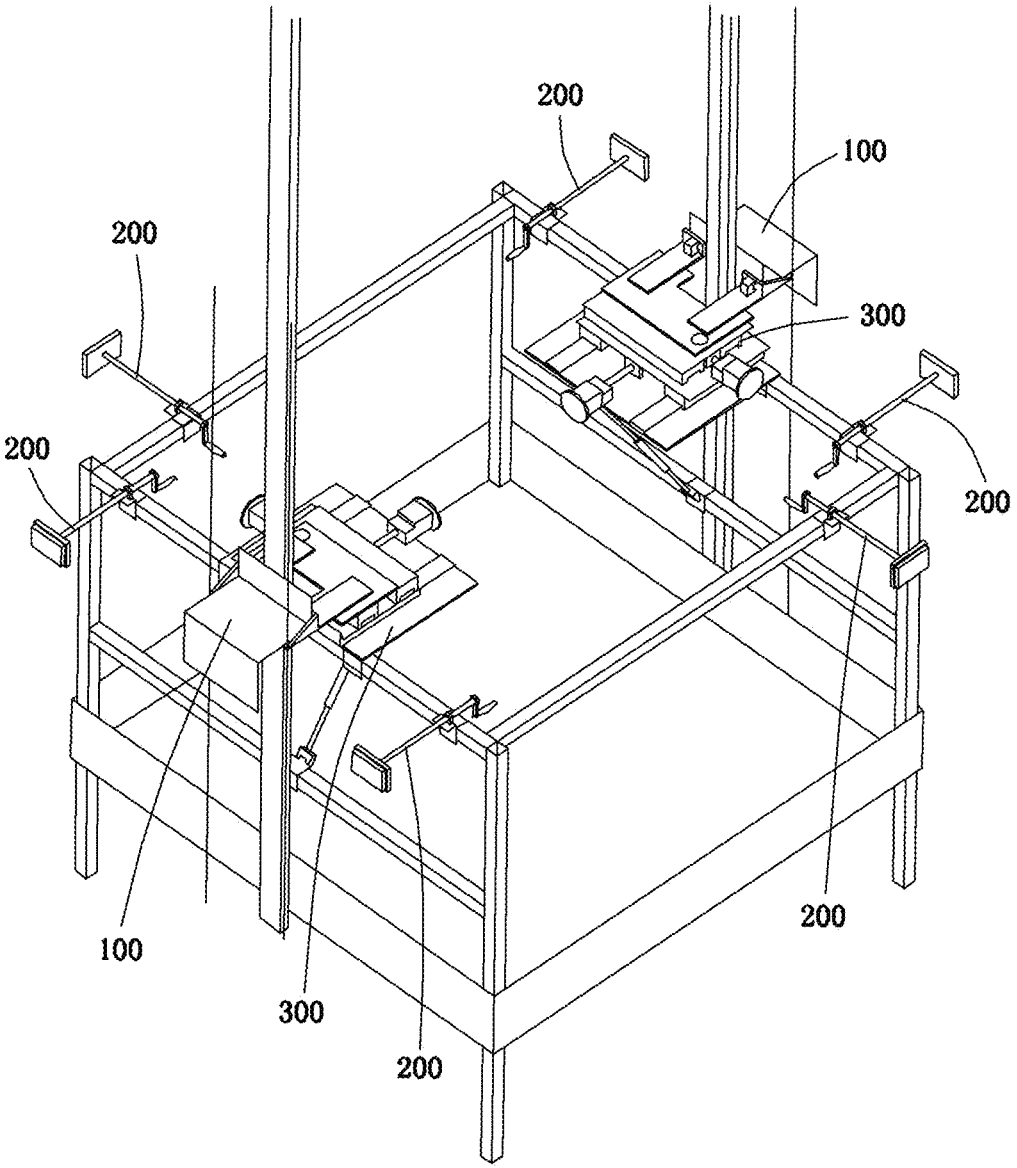
FIG. 8 is a schematic diagram of an embodiment in which a positioning tooling and a bracket adjustment tooling are used to install an elevator guide rail installation bracket on the top of a car.

The present application exemplarily describes the elevator guide rail installation bracket and its associated installation method and tooling with reference to FIGS. 1-8. Wherein, FIGS. 1-2 show an embodiment of the elevator guide rail installation bracket; FIGS. 3-5 show the bracket adjustment tooling for installing the elevator guide rail installation bracket and its application scenarios; FIGS. 6-7 show the positioning tooling used to fix the position of the elevator car when the elevator guide rail installation bracket is installed; and FIG. 8 shows an application scenario where the positioning tooling and the bracket adjustment tooling are used to install the elevator guide rail installation bracket on the top of the car. Each product, tooling and the installation method thereof will be explained one by one as follows.

Referring to FIGS. 1-2, the elevator guide rail installation bracket 100 generally comprises two parts of a guide rail bracket 110 and a hoistway bracket 120. Among them, the guide rail bracket 110 is used for docking and installing guide rails, and the hoistway bracket 120 is used for docking and installing the hoistway. The reason for dividing the elevator guide rail installation bracket into two parts is to provide sufficient adjustable structures and adjustable degrees between the hoistway and the guide rails. For example, the machining accuracy of the hoistway wall surface is normally difficult to make the entire hoistway wall surface in the same horizontal plane. At this time, if an integrated elevator guide rail installation bracket is used, the installation surfaces of the guide rails will not be in the same plane, so it is difficult to meet the requirement for precise alignment of the guide rails. The split-type elevator guide rail installation bracket mentioned in the text can effectively solve this problem.

Specifically, referring to FIG. 1, the guide rail bracket 110 has a guide rail installation surface 111 and a first adjustment surface 112 that form a bend (for example, a 90° bend as shown in the figure). Wherein, a fixed guide rail installation position should be set on the guide rail installation surface 111. This arrangement makes the guide rail and the guide rail bracket 110 have a unique installation relationship, so all adjustment processes are on this side of the elevator guide rail installation bracket 100.

Turning to FIG. 2, the hoistway bracket 120 used in cooperation with the guide rail bracket 110 has a hoistway installation surface 121 and a second adjustment surface 122 that form a bend (for example, a 90° bend as shown in the figure). Regarding the cooperating manner of the two, specifically, the first adjustment surface 112 is configured to be adjustably connected to the second adjustment surface 122 to adjust the relative position between the guide rail installation surface 111 and the hoistway installation surface 121.

The elevator guide rail installation bracket under this arrangement provides a guide rail bracket and a hoistway bracket capable of adjusting relative positions, so that the installation bracket itself has a certain adjustment ability, which can first adjust itself and then install the guide rail with precise positioning, so that the adjustment process of the guide rail installation process changes from the adjustment to an excessively heavy and long guide rail itself to the adjustment to a lighter and more compact elevator guide rail installation bracket, thereby optimizing the process operation accordingly.

The structure and connection relationship of each part of the elevator guide rail installation bracket will be continued to be introduced below in conjunction with FIGS. 1 and 2. In addition, in order to further improve reliability, practicability, economy or out of other improvement considerations, some additional parts may be added, which are also exemplified as follows.

For example, in order to adjust the relative position between the guide rail installation surface 111 of the guide rail bracket 110 and the hoistway installation surface 121 of the hoistway bracket 120, first adjustment slot holes 112*a* may be provided on the first adjustment surface 112, and second adjustment slot holes 122*a* alternately arranged with the first adjustment slot holes 112*a* are provided on the second adjustment surface 122. At this time, a loose fit between the first adjustment surface 112 and the second adjustment surface 122 can be achieved by screwing the first adjustment slot holes 112*a* and the second adjustment slot holes 122*a*. And then, by moving the second adjustment surface 122 relative to the first adjustment surface 112, the hoistway installation surface 121 of the hoistway bracket 120 is moved to abut against the hoistway wall surface to complete the installation of the hoistway installation surface 121. Subsequently, a tight fit between the first adjustment surface 112 and the second adjustment surface 122 is achieved by further screwing the first adjustment slot holes 112*a* and the second adjustment slot holes 122*a*. In this way, the positioning and sufficient adjustment of the elevator guide rail installation bracket can be achieved through simple and common screwing schemes and adjustment slot holes.

For another example, in order to achieve the only installation relationship between the guide rail and the guide rail bracket 110, the following solution may be adopted, that is, a plurality of guide rail fixing circular holes 111*a* are provided on the guide rail installation surface 111 to define a fixed guide rail installation position.

For still another example, in order to improve the applicability and adjustable range of the elevator guide rail installation bracket, third adjustment slot holes 121*a* may also be provided on the hoistway installation surface 121. On the one hand, third adjustable slot holes 121*a* can be used as screw holes between the hoistway installation surface 121 and the wall surface of the hoistway; on the other hand, the arrangement of the third adjustment slot holes 121*a* also makes it possible for the hoistway installation surface 121 and the second adjustment surface 122 to replace with each other. Regarding this solution, the third adjustment slot holes 121*a* should be designed to be alternately arranged with the first adjustment slot holes 112*a*. At this time, the hoistway installation surface 121 and the second adjustment surface 122 can also be configured to have different lengths. At this time, if the length of one of them does not fit the current distance between the car and the wall surface of the hoistway, the other can be used for adjustment.

In addition, it should be noted that an adjustment slot hole is a feature used to realize the aforementioned adjustment function. A slot hole is designed to make the insert (for example, the bolt) have a certain stroke therein, and can be adjusted accordingly, without the need to clearly define its shape. For example, it may be a rectangular hole, a racetrack-shaped hole, an oval hole or a waist-shaped hole. Similarly, a fixed circular hole is a feature used to constrain the guide rail, and it is designed to directly match the insert (for example, a bolt) to avoid additional adjustment and shaking of the guide rail, without the need to excessively limiting its shape. For example, it may be a circular hole or a similar circular hole, a square hole or the like, with a structural contour that can match the insert.

Referring to FIGS. 3-5, a bracket adjustment tooling 300 generally comprises a working platform 310 for performing adjustment actions, and a first calibration arm 321 and a second calibration arm 322 for holding the elevator guide rail installation bracket 100. Specifically, the working platform 310 can be detachably fixed to the guardrail of the elevator car in the construction hoistway by screwing or other means, and a linear motion mechanism and a swing mechanism for performing adjustment actions are provided on it. The first calibration arm 321 and the second calibration arm 322 are respectively arranged on the working platform 310 and configured to jointly hold the elevator guide rail installation bracket 100. Driven by the linear motion mechanism and the swing mechanism, the first calibration arm 321 and the second calibration arm 322 can linearly move and swing along the working platform 310. Such a multi-degree-of-freedom adjustment mechanism can effectively realize the alignment and positioning of the elevator guide rail installation bracket relative to the wall surface of the hoistway.

The structure and connection relationship of each part of the bracket adjustment tooling will be continued to be introduced below in conjunction with FIGS. 3-5. In addition, in order to further improve the reliability, practicability and economy or out of other improvement considerations, some additional parts may be added, which are also exemplified as follows.

For example, as a specific holding solution, end limiting walls 321*a*, 322*a* and side limiting walls 321*b*, 322*b* may be respectively provided at the ends of the first calibration arm 321 and the second calibration arm 322 facing the wall surface of the construction hoistway. The end limiting wall 321*a* and the side limiting wall 321*b* form a clamping angle, and the end limiting wall 322*a* and the side limiting wall 322*b* form another clamping angle, and they both clamp the elevator guide rail installation bracket 100, so as to make the elevator guide rail installation bracket 100 has a fixed positional relationship with the first calibration arm 321 and the second calibration arm 322.

As another example, as another holding solution that can be used alone or in combination with others, magnetic attraction elements 321*c* and 322*c* may also be respectively provided at the ends of the first calibration arm 321 and the second calibration arm 322 facing the wall surface of the construction hoistway. The magnetic attraction elements 321*c* and 322*c* are controlled to generate magnetic force by turning on or off the electric power, so as to attract and hold the elevator guide rail installation bracket 100 made of metal.

Furthermore, regarding the driving mechanism on the working platform 310, several specific driving solutions are also shown. Wherein, the linear motion mechanism may comprise driving mechanisms in two rectilinear directions perpendicular to each other. For example, a first power source 311 and a first platform 312 that is driven to move the first calibration arm 321 and the second calibration arm 322 in a first direction can be provided, and a second power source 313 and a second platform 314 that is driven to move the first calibration arm 321 and the second calibration arm 322 in a second direction can be provided. In application, the first platform 312 can be driven by the first power source 311 to move the guide rail bracket 110 along the longitudinal direction, so that the guide rail bracket 110 is close to the wall surface of the construction hoistway; the second platform 314 can be driven by the second power source 312 to move the guide rail bracket 110 along the lateral direction, so that the guide rail bracket 110 is aligned with the installation point on the wall surface of the construction hoistway.

The swing mechanism may comprise a third power source 315 and a third platform 316 that is driven to swing the first calibration arm 321 and the second calibration arm 322 in a plane formed by the first direction and the second direction. The swing mechanism can make corresponding adjustments when the guide rail bracket 110 is not perpendicular to the wall surface of the hoistway.

In addition, a telescopic leveling mechanism 330 can be additionally provided for the bracket adjustment tooling 300. The first end of this type of telescopic leveling mechanism 330 is connected to the working platform 310, and the second end thereof is detachably fixed to an elevator car in a construction hoistway used as a leveling reference point. At this time, when the working plane of the fixed working platform 310 is still not perpendicular to the wall surface of the hoistway, the working platform 310 can be leveled by extending or retracting the telescopic leveling mechanism 330, and finally the relative position between the bracket adjustment tooling 300 and the elevator car is precisely fixed.

Referring to FIGS. 6-7, the positioning tooling generally comprises three parts of a fixing mechanism 210, a telescopic mechanism 220, and a positioning mechanism 230, so as to facilitate the relative fixation of the elevator car and the wall surface of the hoistway. Specifically, the fixing mechanism 210 is used to detachably fix the entire positioning tooling to the elevator car in the construction hoistway, and the telescopic mechanism 220 connected to the fixing mechanism 210 is configured to extend to or retract from the wall surface of the construction hoistway. In addition, the positioning mechanism 230 is provided at the end of the telescopic mechanism 220, and can abut against the wall surface of the construction hoistway along with the extending motion of the telescopic mechanism 220. The positioning tooling under this arrangement first realizes the fixation with the elevator car, and then realizes the fixation of the car relative to the inner wall of the hoistway through the telescopic adjustment positioning mechanism 230, so that the calibration and installation process of the installation of the elevator guide rail installation bracket can be carried out in a relatively static working environment, thereby improving installation efficiency and reliability.

The structure and connection relationship of each part of the positioning tooling will be continued to be introduced in conjunction with FIGS. 6-7. In addition, in order to further improve reliability, practicability, economy or out of other improvement considerations, some additional parts may be added, which are also exemplified as follows.

For example, as a specific implementation form of the fixing mechanism 210, it may comprise a clamping bracket 211 for clamping and being detachably fixed to the top guardrail of the elevator car in the construction hoistway.

As another example, as a specific implementation form of the telescopic mechanism 220, it may comprise a base 221 and a telescopic screw 222. Wherein, the base 221 is connected to the fixing mechanism 210, and is provided with a threaded through hole matching with the telescopic screw 222, so that the telescopic screw 222 is screwed into the base 221 accordingly. And, a positioning mechanism 230 is provided at its end. At this time, the rotating motion of the telescopic screw 222 relative to the base 221 is converted into the extending motion or retracting motion of the telescopic screw 222 to or from the wall surface of the construction hoistway, and the fixation and release of the relative position between the car and the hoistway is thus realized.

On this basis, in order to avoid interference or collision with the hoistway during the process of completing the construction of the current installation point and going to the next installation point, other structural designs can also be used to provide better storage and avoidance solutions for the telescopic mechanism. As an example, the base 221 of the telescopic mechanism 220 can be pivotally connected to the fixing mechanism 210 and configured to rotate between a position facing the wall surface of the construction hoistway and a position deviating from the wall surface of the construction hoistway, so that in the unused state, the telescopic screw 222 of the telescopic mechanism 220 is adjusted to be arranged substantially parallel to the hoistway to avoid interference between the two.

For another example, as a specific implementation form of the positioning mechanism 230, it may comprise a wall surface support seat 231, wherein the first side of the wall surface support seat 231 is provided with a gasket 232, the second side of the wall surface support seat 231 is arranged at the end of the telescopic mechanism 220, and the gasket 232 abuts against the wall surface of the construction hoistway along with the extending motion of the telescopic mechanism 220. In this arrangement, the wall surface support seat 231 is used to withstand the applied force, and the gasket 232 is used to increase the friction of the contact surface, thereby stably and reliably achieving its positioning function.

Several embodiments of the method of installing the elevator guide rail installation bracket will be described in conjunction with FIG. 8 as follows. First of all, a core idea of this type of installation method is to change the adjustment object during the guide rail installation process, so as to change the adjustment process from the adjustment to an excessively heavy and long guide rail itself into the adjustment to a lighter and more compact elevator guide rail installation bracket.

In order to achieve this purpose, the method comprises the following steps: firstly, a positioning step is performed to fix the relative position between the elevator guide rail installation bracket to be installed and its installation point in the hoistway. Considering that this process involves the bracket adjustment tooling and the operating platform of the operator (for example, usually the top of the elevator car), it is therefore necessary to fix the relative positions of these to achieve the final positioning purpose. As an example, the relative position between the elevator car and the construction hoistway can be fixed at a set construction height in the construction hoistway; and the relative position between the bracket adjustment tooling and the elevator car can also be fixed.

It should be noted that the "elevator car" mentioned in the guide rail installation process in the text refers more to a kind of lifting platform, which can move up and down in the construction hoistway, and can carry operators on it to carry out the guide rail installation method. Generally speaking, an elevator car to be installed in the construction hoistway can be directly selected to be used as the lifting platform; or, a dedicated construction car can also be used; or, a conventional lifting device that is not a car can also be used.

Subsequently, a calibration step is performed to carry out a longitudinal adjustment, lateral adjustment, and swing adjustment of the elevator guide rail installation bracket relative to the wall surface of the construction hoistway using the bracket adjustment tooling. Wherein, the longitudinal adjustment enables the bracket adjustment tooling to carry the elevator guide rail installation bracket close to the wall surface of the construction hoistway, the horizontal adjustment enables the bracket adjustment tooling to carry the elevator guide rail installation bracket to align with the installation point on the wall surface of the construction hoistway, and the swing adjustment can make corresponding adjustments when the elevator guide rail installation bracket carried by the bracket adjustment tooling is not perpendicular to the wall surface of the hoistway. This step can thus realize the positioning of the elevator guide rail installation bracket relative to the wall surface of the construction hoistway.

Then, an installation step is performed to fasten the precisely positioned elevator guide rail installation bracket 100 to the wall surface of the construction hoistway.

The method of installing the elevator guide rail installation bracket under this arrangement can install the guide rail with precise positioning after the elevator guide rail installation bracket is adjusted, so that the adjustment process of the guide rail installation process changes from the adjustment to an excessively heavy and long guide rail itself to the adjustment to a lighter and more compact elevator guide rail installation bracket, thereby optimizing its process operation accordingly.

The method of installing the elevator guide rail installation bracket mentioned in the text by applying the positioning tooling and the bracket adjustment tooling mentioned in the text is also described here in conjunction with FIG. 8.

First, a positioning step is performed to fix the relative position between the elevator guide rail installation bracket to be installed and its installation point in the hoistway. At this time, the clamping bracket 211 of the positioning tooling 200 is used to fix the elevator guide rail installation bracket to the top guardrail of the elevator car. And then, the base 221 and the telescopic screw 222 on it are rotated relative to the clamping bracket 211 to point to the wall surface of the hoistway. Then, the telescopic screw 222 is turned to further extend from the base 221 until the gasket 232 on the wall surface support seat 231 at its end abuts against the wall surface of the hoistway. By performing the aforementioned steps by 4 to 6 times at different positions on the car guardrail and different positions on the hoistway wall, 4 to 6 positioning toolings 200 are assembled, and the relative position between the elevator car and the construction hoistway can be better fixed. At the same time, the working platform 310 of the bracket adjustment tooling 300 can also be fixed to the top guardrail of the elevator car by a similar clamping bracket, and the working plane of the working platform 310 can be ensured to be perpendicular to the wall surface of the hoistway by the optional telescopic leveling mechanism 330, so that the relative position between the bracket adjustment tooling 300 and the elevator car is fixed.

Second, a calibration step is performed. At this time, the first calibration arm 321 and the second calibration arm 322 of the bracket adjustment tooling 300 are first used to hold the guide rail bracket 110 of the elevator guide rail installation bracket 100. Then, the bracket adjustment tooling 300 carries out a longitudinal adjustment, lateral adjustment, and swing adjustment of the elevator guide rail installation bracket 100 relative to the wall surface of the construction hoistway. Specifically, the first platform 312 is driven by the first power source 311 to carry the guide rail bracket 110 to move in the longitudinal direction so as to be close to the wall surface of the construction hoistway; the second platform 314 is driven by the second power source 312 to carry the guide rail bracket 110 to move in the lateral direction, so that the guide rail bracket 110 is aligned with the installation point on the wall surface of the construction hoistway; the third platform 316 is driven by the third power source 315 to carry the guide rail bracket 110 to swing, so that corresponding adjustments can be made when the guide rail bracket 110 is not perpendicular to the wall surface of the hoistway.

Furthermore, after the guide rail bracket 110 is aligned with the installation point on the wall surface of the hoistway, the hoistway bracket 120 is connected to it through a loose fit, and the relative position between the guide rail installation surface 111 of the guide rail bracket 110 and the hoistway installation surface 121 of the hoistway bracket 120 is adjusted to realize the positioning of the hoistway installation surface 121 relative to the wall surface of the construction hoistway, so as to accurately obtain the drilling position to drill an installation hole.

And then, an installation step is performed. On the one hand, the hoistway bracket 120 is fastened to the wall surface of the construction hoistway, and on the other hand, the loose fit connection between the hoistway bracket 120 and the guide rail bracket 110 is tightened into a tight fit. Thus, the entire installation process of the elevator guide rail installation bracket 100 is completed.

Thereafter, with the help of the elevator guide rail installation bracket 100, the installation of the guide rail segments can be directly completed, and press-fit plates are used to further fix the guide rail to the installation bracket 100 to complete the installation of the guide rail segments. Then, the foregoing operations are repeated at the next installation point to complete the alignment and installation of the entire guide rail. It should be understood that the aforementioned installation process is usually carried out in the hoistway from bottom to top.

The method of installing the elevator guide rail installation bracket under this arrangement has a closer fit with the installation bracket and tooling mentioned in the text, and provides a complete set of specific solutions for changing the adjustment object during the installation process of the guide rail, so as to change the adjustment process from the adjustment to an excessively heavy and long guide rail itself to the adjustment to a lighter and more compact elevator guide rail installation bracket. This solution can install the guide rail with precise positioning after the elevator guide rail installation bracket is adjusted, so that the adjustment process of the guide rail installation process changes from the adjustment to an excessively heavy and long guide rail itself to the lighter and more compact elevator guide rail installation bracket, thereby optimizing its process operation.

In addition, although a variety of toolings mentioned in the text are simultaneously applied in the foregoing method, it should be noted however that each of these toolings is independent in terms of function and structure. They can be used together or separately. For example, when implementing the aforementioned method, only the aforementioned bracket adjustment tooling 300 may be used, while the aforementioned positioning tooling 200 is not used but assisted with other positioning solutions, which can also achieve similar technical effects.

Regarding any embodiment of the method of installing the elevator guide rail installation bracket mentioned above, it should also be noted that unless there is a certain sequence dependency between the various steps or the various operations within the steps, the sequence of implementing these steps or implementing the operations within the steps can be changed. For example, the completion of the positioning step is conducive to the realization of the calibration step, and the completion of the calibration step can make it possible to complete the final installation step. For another example, there is no interdependence between the fixing operation of the elevator car and the hoistway and the fixing operation of the bracket adjustment tooling and the elevator car in the positioning step, so any one of them can be implemented first.

In addition, regarding any embodiment of the method of installing the elevator guide rail installation bracket mentioned above, there may also be related method steps to achieve auxiliary purposes. For example, in the calibration process of the bracket adjustment tooling, vertical lines can be arranged to provide a reference for alignment. For another example, before the installation step and after the calibration is completed, drilling can be carried out at an accurate position obtained from the wall surface of the hoistway by means of electric drilling or laser positioning drilling.

Furthermore, although not shown in the figures, an embodiment of an elevator system is also provided herein. The elevator system may comprise the elevator guide rail installation bracket in any of the foregoing embodiments or combinations thereof, and may adopt the method of installing the elevator guide rail installation bracket in any of the foregoing embodiments or combinations thereof, supplemented by the positioning tooling and the bracket adjustment tooling in any of the foregoing embodiments or combinations thereof to assisted in installation. Accordingly, it also has various technical effects brought about by each of the solutions, which will not be repeated here.

The above examples mainly illustrate the elevator guide rail installation bracket and installation method thereof, positioning tooling, bracket adjustment tooling and elevator system of the present application. Although only some of the embodiments of the present application are described, those skilled in the art understand that the present application can, without departing from the spirit and scope thereof, be implemented in many other forms. Therefore, the illustrated examples and embodiments are to be considered as illustrative but not restrictive, and the present application may cover various modifications or replacements if not departed from the spirit and scope of the present application as defined by the appended claims.

What is claimed is:

1. A positioning tooling for an elevator car, comprising:

a fixing mechanism detachably fixed to an elevator car in a construction hoistway;

a telescopic mechanism connected to the fixing mechanism and configured to extend to or retract from the wall surface of the construction hoistway; and a positioning mechanism provided at the end of the telescopic mechanism that abuts against the wall surface of the construction hoistway along with the extending motion of the telescopic mechanism;

wherein the telescopic mechanism includes:

a base connected to the fixing mechanism and provided with a threaded through hole; and a telescopic screw screwed to the threaded through hole of the base, with its end provided with the positioning mechanism;

wherein, the rotating motion of the telescopic screw relative to the base is converted into an extending motion or a retracting motion of the telescopic screw to or from the wall surface of the construction hoistway;

wherein the base is pivotally connected to the fixing mechanism by a hinge, and is configured to rotate relative to the fixing mechanism between a position facing the wall surface of the construction hoistway and a position deviating from the wall surface of the construction hoistway.

2. The positioning tooling according to claim 1, wherein the fixing mechanism comprises a clamping bracket for clamping and being detachably fixed to a top guardrail of the elevator car in the construction hoistway.

3. The positioning tooling according to claim 1, wherein the positioning mechanism comprises a wall surface support seat, and wherein the first side of the wall surface support seat is provided with a gasket, the second side of the wall surface support seat is arranged at the end of the telescopic mechanism, and the gasket abuts against the wall surface of the construction hoistway along with the extending motion of the telescopic mechanism.

* * * * *